US005915341A

United States Patent [19]

Moroi et al.

[11] Patent Number: 5,915,341

[45] Date of Patent: Jun. 29, 1999

[54] VISCOUS HEATER WITH SHEAR FORCE INCREASING MEANS

[75] Inventors: Takahiro Moroi; Takashi Ban; Tatsuya Hirose; Kiyoshi Yagi, all of Aichi-ken, Japan

[73] Assignee: Kabushiki Kaisha Toyoda Jidoshokki Seisakusho, Kariya, Japan

[21] Appl. No.: 09/018,167

[22] Filed: Feb. 3, 1998

[30] Foreign Application Priority Data

Feb. 26, 1997 [JP] Japan ..... 9-042315

[51] Int. Cl.[6] ..... F22B 3/06

[52] U.S. Cl. ..... 122/26; 126/247

[58] Field of Search ..... 122/26; 126/247

[56] References Cited

U.S. PATENT DOCUMENTS

| | | | |
|---|---|---|---|
| 4,273,075 | 6/1981 | Freihage | 122/26 |
| 4,277,020 | 7/1981 | Grenier | 122/26 |
| 4,781,151 | 11/1988 | Wolpert, Jr. et al. | 122/26 |
| 5,279,262 | 1/1994 | Muehleck | 122/26 |

FOREIGN PATENT DOCUMENTS 2246823 10/1990 Japan .

*Primary Examiner*—Teresa Walberg
*Assistant Examiner*—Gregory A. Wilson
*Attorney, Agent, or Firm*—Morgan & Finnegan, L.L.P.

[57] ABSTRACT

A viscous heater which can increase the amount of generated heat without any special means of enlarging the heat generating effective region. A heater housing is made up of an intermediate housing (1), a cylindrical stator member (2), a front housing (5) and a rear housing (6). The heater housing defines therein a heat generating chamber (7) and a heat radiating chamber (water jacket) (8) around the heat generating chamber. Front and rear drive shafts (12A), (12B) and a rotor (20) are disposed in the heat generating chamber (7) to be rotatable together, while silicone oil as a viscous fluid is also sealed in the heat generating chamber (7) A plurality of grooves (31, 32) extending in the axial direction of the rotor are formed respectively on an outer circumferential surface of the rotor (20) and an inner circumferential surface of the stator member (2), the grooves serving as shearing force increasing means.

10 Claims, 4 Drawing Sheets

VISCOUS HEATER WITH SHEAR FORCE INCREASING MEANS

BACKGROUND OF THE INVENTION

1. Field of the Invention

The present invention relates to a viscous heater incorporated in a heating system for motor vehicles, etc. wherein a heat generating chamber and a heat radiating chamber are partitioned in a housing, a viscous fluid sealed in the heat generating chamber is subjected to shearing upon the rotation of a rotor to generate heat, and the generated heat is transmitted to a circulating fluid in the heat radiating chamber, thereby heating the circulating fluid.

2. Description of Related Art

As an auxiliary heat source loaded in motor vehicles, viscous heaters utilizing the driving force of an engine have received attention recently. Japanese Patent Application Laid-open No. 2-246823, for example, discloses a viscous heater incorporated in a heating system for motor vehicles.

In the disclosed viscous heater, front and rear housings are coupled together in opposite relation to each other to define therein a heat generating chamber and a water jacket (i.e., a heat exchange chamber) around the heat generating chamber. A drive shaft is rotatably supported by the front housing through a bearing unit, and a rotor is fixed to one end of the drive shaft to be rotatable with it in the heat generating chamber. Concentric recesses and projections are formed in complementary relation to mesh with each other on the front and rear outer wall surfaces of the rotor and the front and rear inner wall surfaces of the heat generating chamber. These recesses and projections are closely positioned to define labyrinthine clearances (labyrinth grooves) between the above outer and inner wall surfaces. A predetermined amount of viscous fluid (silicone oil, for example) is sealed in the heat generating chamber to fill the labyrinth grooves.

When the driving force of the engine is transmitted to the drive shaft, the rotor is rotated in the heat generating chamber together with the drive shaft, and the viscous fluid between the inner wall surfaces of the heat generating chamber and the outer wall surfaces of the rotor is subject to shearing upon the rotation of the rotor to generate heat based on fluid friction. The heat generated in the heat generating chamber is transmitted to the circulating water flowing in the water jacket, and the heated circulating water is then supplied to an external heating circuit to heat the motor vehicle.

The amount of heat generated by the above stated conventional viscous heater increases with an increase in the contact area of the viscous fluid, i.e., the total surface area of the outer wall surfaces of the rotor and the inner wall surfaces of the heat generating chamber. On the other hand, when a viscous heater is utilized as a heat source for heating motor vehicles, from the standpoint of ensuring enough space to mount other automotive accessories in the engine compartment, there is a need to make the viscous heater as small as possible. For this reason, the above conventional viscous heater increases the amount of heat generated with labyrinth grooves which are formed between the front and rear outer wall surfaces of the rotor and the front and rear inner wall surfaces of the heat generating chamber in opposite relation to enlarge the total surface area of the outer wall surfaces of the rotor and the inner wall surfaces of the heat generating chamber, i.e., to make the contact area (hereinafter referred to as the effective heat generating region) between these parts and fluid larger so as to increase the shearing force applied to the viscous liquid, while avoiding an increase in the size of the rotor and the housing.

However, the labyrinth grooves must be provided by machining the rotor and the inner wall surfaces of the heat generating chamber to form complicated recesses and projections. This manufacturing technique raises problems as it is difficult to achieve high machining accuracy of the recesses and projections and it increases the production costs. It is thus difficult to practically employ a structure with labyrinth grooves. Specifically, in the above conventional viscous heater wherein the labyrinth grooves are defined by the concentric recesses and projections formed about the axis of the rotor, the rotor may interfere with the inner wall surfaces of the housing with even a slight inclination of the drive shaft unless the recesses and projections are machined and assembled with extremely high accuracy.

SUMMARY OF THE INVENTION

An object of the present invention is to provide a viscous heater, based on a totally different concept than the above-stated conventional viscous heater, which can increase the amount of generated heat without any special means for enlarging the effective heat generating region. Another object is to provide a viscous heater which is suitable for easier mounting in motor vehicles and other products.

According to a first aspect of the present invention, in a viscous heater wherein a heat generating chamber and a heat radiating chamber are partitioned in a housing, a viscous fluid sealed in the heat generating chamber is subject to shearing upon the rotation of a rotor to generate heat, and the generated heat is transmitted to a circulating fluid in the heat radiating chamber, thereby heating the circulating fluid. The viscous heater comprises a partitioning means provided in the housing to surround the outer periphery of the rotor to define the heat generating chamber on the inner peripheral side of the partitioning means and the heat radiating chamber on the outer peripheral side of the partitioning means, and a shearing force increasing means provided on at least the rotor or the partitioning means to increase the shearing force exerted on the viscous fluid. The shearing force increasing means is constructed so that the gap size between the rotor and the partitioning means varies along the direction of rotation of the rotor.

With this viscous heater, since the partitioning means is provided to surround the outer periphery of the rotor, the heat radiating chamber is disposed such that it surrounds the heat generating chamber and the rotor accommodated in the heat generating chamber. The outer circumferential surface of the rotor has a maximum circumferential speed during rotation and serves as the main shearing action surface. In addition, because the heat radiating chamber surrounds the outer circumferential surface of the rotor, heat generated near the outer circumferential surface of the rotor is transmitted to the circulating fluid flowing in the heat radiating chamber efficiently via the shortest path. Further, since the shearing force increasing means is provided on at least the rotor or the partitioning means to vary the gap size between the rotor and the partitioning means along the direction of rotation of the rotor, the action of confining molecular chains in the viscous fluid is promoted by the repeated increasing and decreasing change of the gap size that accompanies the relative movement between the rotor and the partitioning means. This confining action restrains the tendency of the viscous fluid to rotate, to some extent, together with the rotation of the rotor. The shearing force exerted on the viscous fluid is consequently increased to increase the amount of heat generated by the viscous heater.

According to a second aspect of the present invention, in the viscous heater according to the first aspect, the shearing force increasing means is constituted by recesses and projections formed to extend in a direction other than the direction of rotation of the rotor on at least the outer circumferential surface of the rotor or the inner circumferential surface of the partitioning means positioned to face the outer circumferential surface of the rotor.

With this feature, since the recesses and projections constituting the shearing force increasing means are formed to extend in a direction other than the direction of rotation of the rotor, the gap between the inner circumferential surface of the partitioning means on the stationary side and the outer circumferential surface of the rotor can be changed to repeatedly increase and decrease along the direction of rotation of the rotor. Accordingly, the shearing force exerted on the viscous fluid is increased to increase the amount of heat generated by the viscous heater as in the above first aspect. Further, when the rotor rotates, bubbles (gas) mixed in the viscous fluid are collected into the recesses constituting part of the shearing force increasing means (gas capturing action). Therefore, gas is purged from regions other than those recesses, i.e., regions of the inner circumferential surface of the partitioning means and the outer circumferential surface of the rotor which defines the gap between the outer circumferential surface of the rotor and the inner circumferential surface of the partitioning means (namely, the effective heat generating region), thus resulting in higher shearing efficiency of the viscous fluid.

According to a third aspect of the present invention, in the viscous heater according to the first aspect, the rotor comprises a pair of disk-like support members spaced from each other by a predetermined distance in the longitudinal direction, and a plurality of connecting members fixedly attached to the outer peripheries of the disk-like support members. The connecting members, serving as the shearing force increasing means, are moved along the inner circumferential surface of the partitioning means upon rotation of the rotor while maintaining an opposed relation to the inner circumferential surface of the partitioning means.

With this feature, the plurality of connecting members serve as the shearing force increasing means. In addition, gaps, through which the interior of the rotor is communicated with the exterior thereof, are defined between adjacent connecting members fixedly attached to the outer peripheries of the disk-like support members. The inner space of the rotor can therefore be utilized as an extra chamber for storing the viscous fluid. This is advantageous in that it enables the viscous fluid to be stored in a larger amount and delays its deterioration. Use of the rotor having a cage-like shape is also effective in reducing start-up torque.

According to a fourth aspect of the present invention, in the viscous heater according to the first aspect, the shearing force increasing means is constituted by a plurality of dimples which are formed in a distributed manner on at least an outer circumferential surface of the rotor or an inner circumferential surface of the partitioning means positioned to face the outer circumferential surface of the rotor.

By forming such dimples, the shearing force increasing means can also be easily provided on at least the outer circumferential surface of the rotor or the inner circumferential surface of the partitioning means.

According to a fifth aspect of the present invention, in the viscous heater according to the first aspect, the rotor has a cylindrical shape such that the outer circumferential surface has an axial length greater than the radius.

With this feature, the rotor can have a radius smaller than the axial length, and therefore a viscous heater having a radius smaller than that of conventional viscous heaters can be provided. Of all the surfaces of the rotor, the outer circumferential surface exhibits the maximum circumferential speed during operation. However, on condition that the angular speed of the rotor is constant, the circumferential speed at the outer circumferential surface of the rotor decreases as the rotor's radius decreases. Nevertheless, the area of the outer circumferential surface of the rotor is increased by increasing the axial length of the rotor. As a result, although the smaller radius of the rotor decreases the circumferential speed and reduces the amount of generated heat, this reduction in the amount of generated heat can be compensated for by the increased axial length of the rotor.

According to a sixth aspect of the present invention, in the viscous heater according to the second aspect, the recesses and projections are constituted by forming a plurality of grooves extending in the axial direction of the rotor on at least the outer circumferential surface of the rotor or the inner circumferential surface of the partitioning means.

By forming the grooves extending in the axial direction of the rotor, the recesses and projections constituting the shearing force increasing means can be easily provided.

According to a seventh aspect of the present invention, in the viscous heater according to the fifth aspect, the heat radiating chamber includes a circulating passage defined in a spiral form for a circulating fluid in the heat radiating chamber.

With the circulating passage defined in a spiral form, it is possible to regulate the flow of the circulating fluid and prevent a short-circuiting or stagnation of the circulating fluid, hence improving the efficiency of heat exchange.

According to an eighth aspect of the present invention, in the viscous heater according to the sixth aspect, the recesses and projections are constituted by forming a plurality of grooves extending in the axial direction of the rotor on both the outer circumferential surface of the rotor and the inner circumferential surface of the partitioning means, and setting the number of grooves on the rotor to be different from the number of grooves on the partitioning means.

If the number of grooves on the rotor are set to be the same as the number of grooves on the partitioning means and the grooves on the rotor and the partitioning means are arranged about the rotor axis with equal angular intervals therebetween, the grooves on both sides would all be positioned to face each other at the same time when any one of the grooves on the rotor comes into opposed relation with one of the grooves on the partitioning means during the rotation of the rotor, and such a condition would be generated cyclically. In such a case, the molecule confining action of the shearing force increasing means would also therefore develop cyclically and the load of the rotor during rotation would change in a pulsating fashion, thereby causing vibrations and noise. In contrast, in the viscous heater according to the eighth aspect, the number of grooves on the rotor is set to be different from the number of grooves on the partitioning means so that the angular intervals between the grooves arranged on the rotor are not equal to those between the grooves arranged on the partitioning means. It is hence possible to keep the plurality of grooves on the rotor and the plurality of grooves on the partitioning means from all being positioned to face each other at the same time. Also, the molecule confining action of the shearing force increasing means develops non-cyclically. Consequently, load variations during the rotation of the rotor are prevented from becoming pulsatory and the occurrence of vibrations and noise can be held down.

DESCRIPTION OF THE PREFERRED EMBODIMENTS

Several preferred embodiments in which the present invention is applied to a viscous heater incorporated in a heating system for motor vehicles will be described below with reference to the drawings.

(First Embodiment)

Figure 1:
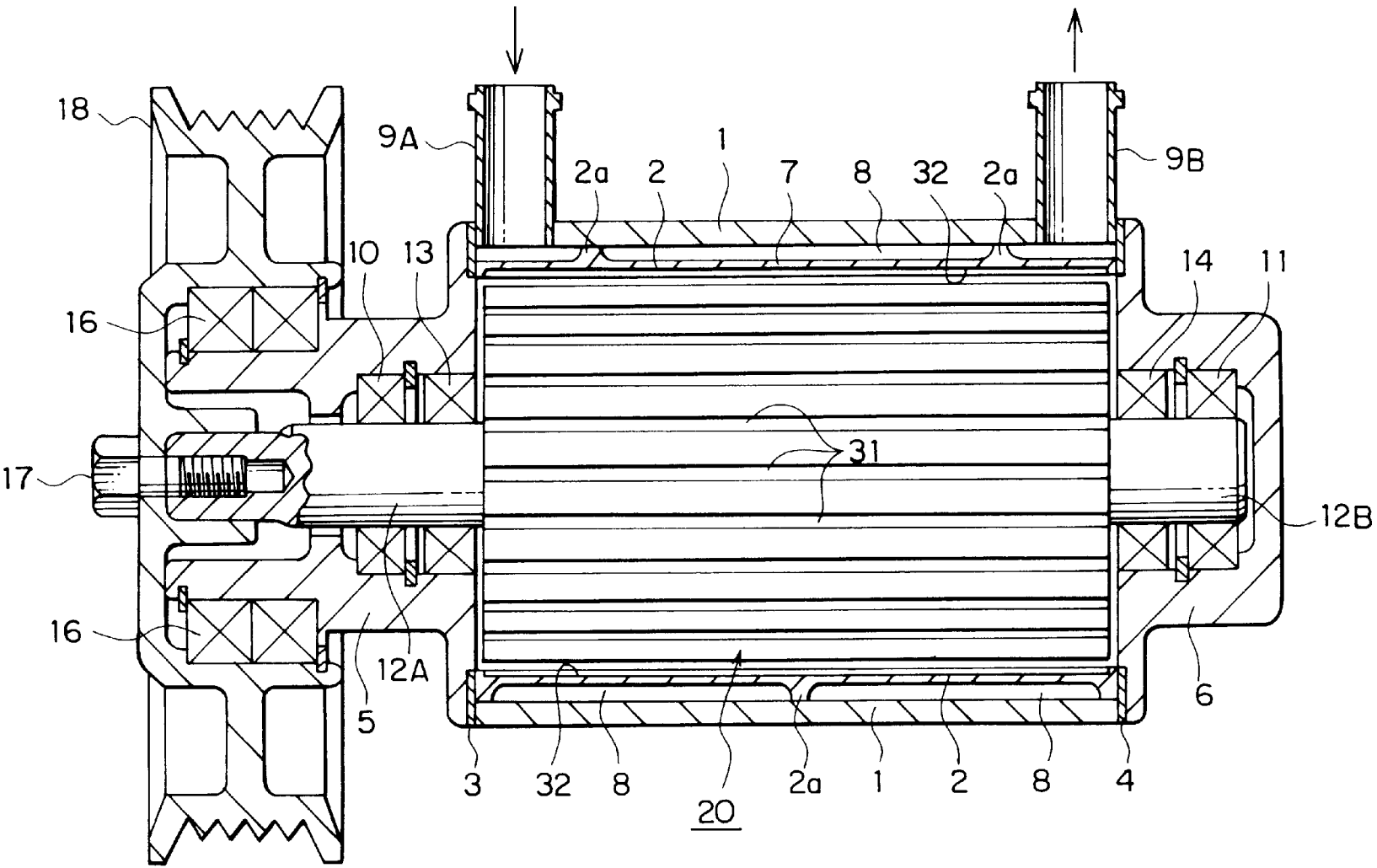
FIG. 1 is a longitudinal sectional view of a viscous heater according to a first embodiment.
Figure 3:
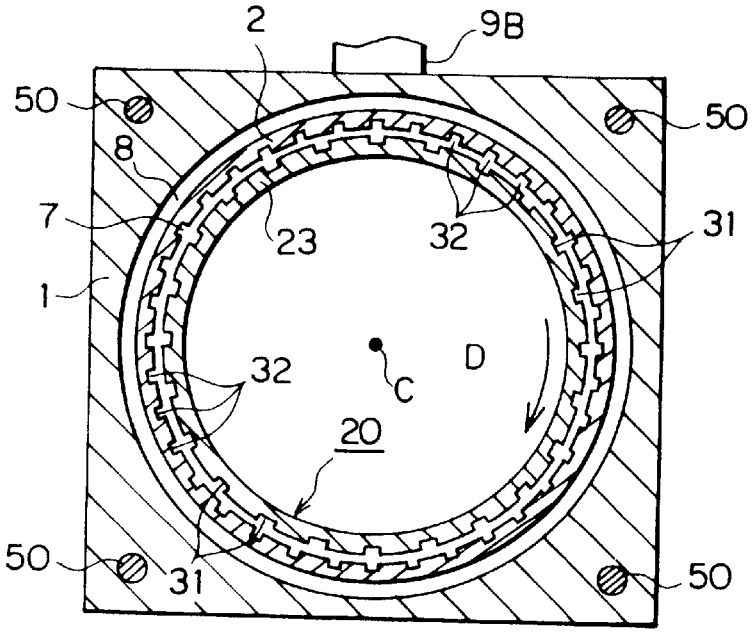
FIG. 3 is a transverse sectional view taken along the line X—X in FIG. 2.

As shown in FIGS. 1 and 3, a viscous heater of this embodiment has a housing made up of an intermediate housing 1, a stator member 2, a front housing 5 and a rear housing 6. The intermediate housing 1 is formed to have a rectangularly configured outer cross section/end, a cylindrical inner peripheral wall surface. The stator member 2 has a substantially cylindrical shape and is press-fitted in the intermediate housing 1. Front and rear housings 5, 6 are joined respectively to front and rear ends of the intermediate housing 1 and the stator member 2 through gaskets 3, 4. A heat generating chamber 7 is thus defined by the stator member 2 which serves as a partitioning means. Additionally, the intermediate housing 1, the front housing 5 and the rear housing 6 are coupled to each other by four assembly bolts 50 (see FIG. 3).

A single rib 2*a* is spirally projected on an outer circumferential surface of the stator member 2. With the stator member 2 press-fitted in the intermediate housing 1, the rib 2*a* is held in close contact with the inner circumferential surface of the intermediate housing 1. A water jacket 8 serving as a heat radiating chamber is thus defined between the outer circumferential surface of the stator member 2 and the inner circumferential surface of the intermediate housing 1. An inlet port 9A for taking circulating water serving as a circulating fluid into the water jacket 8 from a heating circuit (not shown) of a motor vehicle is provided at a front end of the intermediate housing 1 on its outer peripheral surface, while an outlet port 9B for delivering the circulating water from the water jacket 8 to the heating circuit is provided at a rear end of the intermediate housing 1 on its outer peripheral surface. In the water jacket 8, the rib 2*a* serves as circulating fluid guide means for creating a spiral passage for the circulating fluid which extends from the inlet port 9A to the outlet port 9B.

Figure 2:
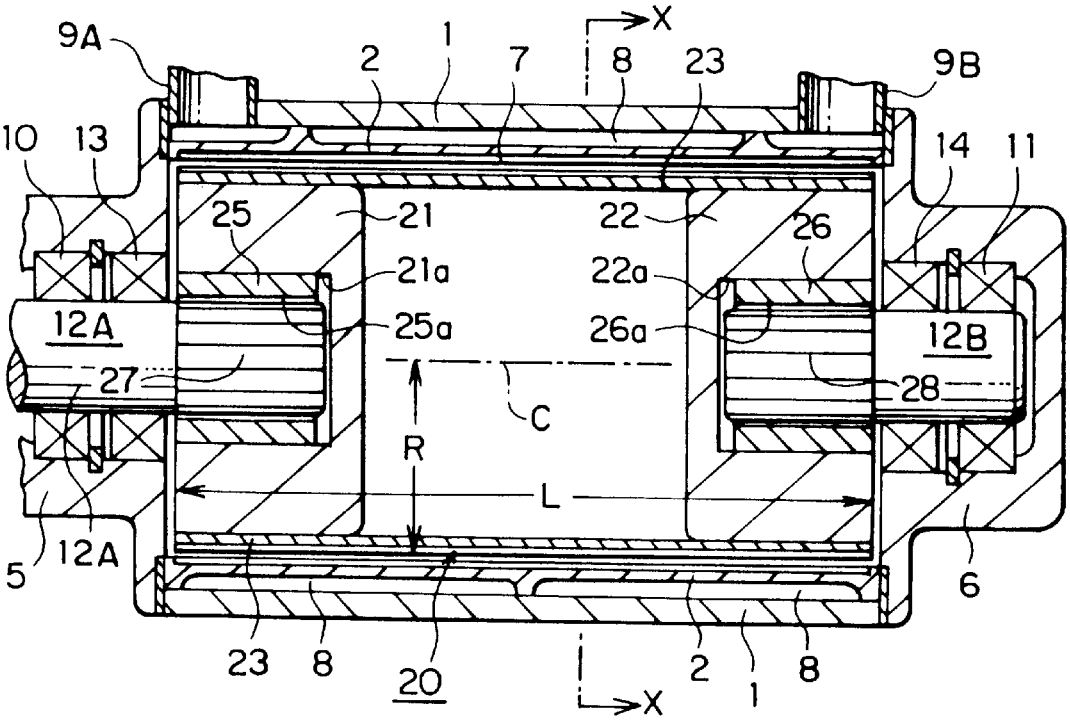
FIG. 2 is a further longitudinal sectional view, showing the interior of a rotor of the viscous heater shown in FIG. 1.

As shown in FIGS. 1 and 2, a rotor 20 is placed in the heat generating chamber 7. Drive shafts 12A, 12B are respectively provided at front and rear ends of the rotor 20. The front drive shaft 12A is rotatably supported by a bearing unit 10 disposed in the front housing 5, and the rear drive shaft 12B is rotatably supported by a bearing unit 11 disposed in the rear housing 6. The two drive shafts 12A, 12B are coaxially positioned on the same axis C and, although they are separately provided at the front and rear ends of the rotor 20, function as one drive shaft by being interconnected through the rotor 20.

As shown in FIG. 2, the rotor 20 surrounded by the substantially cylindrical stator member 2 comprises a pair of disk-shaped support members 21, 22 and cylindrical outer periphery member 23 that faces the inner circumferential surface of the stator member 2. The members 21, 22, 23 are made of an aluminum alloy for the purpose of reducing the weight of the rotor. The disk-shaped support members 21, 22 are press-fitted to front and rear ends of the cylindrical outer periphery member 23, respectively, so that the rotor 20 has a hollow drum-like shape. The rotor 20 (or the cylindrical outer periphery member 23) has a cylindrical outer peripheral surface with an axial length L that is longer than a radius R and its center is located on its axis C (aligned with the axes of the drive shafts 12A, 12B) Further, steel-made cylindrical rings 25, 26 are press-fitted in recesses 21*a*, 22*a*, respectively, formed in central portions of the disk-shaped support members 21, 22. Inner splines 25*a*, 26*a* are formed in respective inner circumferential surfaces of the cylindrical rings 25, 26 and are fitted to outer splines 27, 28 formed in respective outer circumferential surfaces of the drive shafts 12A, 12B. In this way, the rotor 20 is constructed to be rotatable together with the two drive shafts 12A, 12B and is rotatably supported by the bearing units 10, 11 through the drive shafts 12A, 12B.

An oil seal 13 as a shaft sealing device is disposed in the front housing 5 adjacent to the heat generating chamber 7, and an oil seal 14 as a shaft sealing device is disposed in the rear housing 6 adjacent to the heat generating chamber 7. The heat generating chamber 7 is thus formed as a liquid-tight inner space in which the rotor 20 is accommodated.

A predetermined amount of silicone oil as a viscous fluid is filled in the heat generating chamber 7 as a liquid-tight inner space. A silicone oil fill amount Vf is determined such that the filling ratio of the silicone oil at a normal temperature to a total clearance volume Vc given by the sum of the clearance between the outer circumferential surface of the rotor 20 (i.e., the outer circumferential surface of the outer periphery member 23) and the inner circumferential surface of the stator member 2, as well as clearances between the front and rear end surfaces of the rotor 20 and the front and rear housings 5, 6 is in the range of 50% to 80%. The above filling ratio is determined considering the expansion of silicone oil when heated. Note that a filling ratio of silicone oil less than 100% does not significantly impede heating of the oil due to shearing because the oil is forced to fully spread into the gap between the inner wall surface of the heat generating chamber 7 and the outer circumferential surface of the rotor 20 by extension viscosity.

Also as shown in FIG. 1, a pulley 18 is rotatably supported by a bearing unit 16 provided on the front housing 5. The pulley 18 is fixedly attached to an end of the front drive shaft 12A by a bolt 17. The pulley 18 is operatively coupled to an engine of a motor vehicle as an external driving source through a power transmitting belt (not shown) wound over an outer periphery of the pulley 18. Accordingly, the rotor 20 and the rear drive shaft 12B are rotated together with the front drive shaft 12A by the driving force of the engine transmitted through the pulley 18. The rotation of the rotor 20 subjects the silicone oil to shearing to generate heat mainly in the gap between the inner wall surface of the heat generating chamber 7 (the inner circumferential surface of the stator member 2) and the outer circumferential surface of the rotor 20 (the outer circumferential surface of the outer periphery member 23). The generated heat is transmitted to the circulating water flowing in the water jacket 8 by heat exchange through the stator member 2, and the heated circulating water is supplied to the heating circuit to, by way of example, heat a passenger room of a motor vehicle.

The heat generating ability due to shearing by a rotor is approximately calculated on condition that the rotor has an outer circumferential surface that is not rugged, but smooth. Assuming that the coefficient of viscosity of a viscous fluid is $\mu$, the gap between the outer circumferential surface of the rotor 20 and the inner wall surface of the heat generating chamber 7 (the stator member 2) is $\delta_1$, the gap between each of the end surfaces of the rotor 20 and the corresponding inner end surfaces of the heat generating chamber 7 is $\delta_2$, and the angular speed of the rotor is $\omega$, the amount $Q_1$ of heat generated at each end surface of the rotor 20 is given by;

$$Q_1=\pi\mu\omega^2R^4/\delta_2$$

and the amount $Q_2$ of heat generated at the outer circumferential surface of the rotor 20 is given by:

$$Q_2=2\pi\mu\omega^2R^3L/\delta_1$$

In this viscous heater, since the outer circumferential surface of the rotor 20 serves as the main shear acting surface, the relation of $\delta_1<\delta_2$ is established in addition to the relation of the radius R< the axial length L, thus resulting in the relation of $Q_1<Q_2$. It can be therefore understood that a larger amount $Q_2$ of heat is generated at the outer circumferential surface of the rotor 20.

Further, as shown in FIGS. 1 and 3, a plurality of grooves 31, 32 are formed respectively on the outer circumferential surface of the drum-like rotor 20 (i.e., the outer circumferential surface of the outer periphery member 23) and the corresponding inner circumferential surface of the stator member 2. The grooves 31, 32 constitute a shearing force increasing means to increase the shearing force exerted on the viscous fluid.

The grooves 31 formed on the outer circumferential surface of the rotor 20 and the grooves 32 formed on the inner circumferential surface of the stator member 2 in the axial direction of the rotor 20 parallel to each other. The direction in which the axis C of the rotor 20 extends is perpendicular to the direction D of rotation of the rotor 20 and the circumferential direction thereof. This means that each groove 31, 32 extends in a direction other than the direction D of rotation of the rotor 20. Also, by arranging the plurality of grooves 31, 32 respectively on the rotor 20 and the stator member 2 in the direction D of rotation of the rotor 20, a plurality of recesses and projections each extending in the axial direction of the rotor 20 are defined on the outer circumferential surface of the rotor 20 and the inner circumferential surface of the stator member 2.

In this embodiment, the number of the grooves 31 formed on the outer circumferential surface of the rotor 20 is set at 24, and the grooves 31 are arranged side by side in the circumferential direction of the rotor 20 with equal angular intervals (i.e., 15°) therebetween. On the other hand, the number of the grooves 32 formed on the inner circumferential surface of the stator member 2 is set at 36, and the grooves 32 are arranged side by side in the circumferential direction of the stator member 2 with equal angular intervals (i.e., 10°) therebetween. Thus, the number of the grooves 31 on the rotor 20 is different from the number of the grooves 32 on the stator member 2.

The depth of each of the grooves 31, 32 is set to be greater than the clearance (gap) between the outer circumferential surface of the rotor 20 and the inner circumferential surface of the stator member 2. In addition, as shown in FIG. 3, the grooves 31, 32 are each rectangular in cross section and the tops of both side walls defining each groove are intentionally not chamfered so that the angled edges are left as they are.

To prevent the heat generating ability of the viscous fluid due to the shearing force from being somewhat lowered because of a partial increase in the clearance between the outer circumferential surface of the rotor 20 and the inner circumferential surface of the stator member 2 resulting from the formation of the grooves 31, 32, the areas of the grooves 31, 32 are desirably set such that the percentage of the total area occupied by the grooves 31 to the area of the outer circumferential surface of the rotor 20 and the percentage of the total area occupied by the grooves 32 to the inner circumferential surface of the stator member 2 are each not larger than 20%.

The operation and advantages of the viscous heater of this embodiment will now be described.

With the presence of the grooves 31, 32, the gap size between the outer circumferential surface of the rotor 20 and the inner circumferential surface of the stator member 2 varies alternately increasing and decreasing along the direction D of rotation of the rotor 20. Therefore, in addition to the action of surface tension of the viscous fluid, the action of confining molecule chains of the viscous fluid is promoted in portions where the gap size increases, i.e., in positions of the grooves 31, 32. This increases the shearing force exerted on the viscous fluid upon the rotation of the rotor 20. As a result, the amount of heat generated by the viscous heater can be increased in comparison with the case of not forming the grooves 31, 32.

The grooves 31, 32 extending in the axial direction lie in substantially perpendicular relation to the viscous fluid moving with the rotation of the rotor 20 in the direction D of rotation of the rotor 20. Accordingly, the grooves 31, 32 constituting the shearing force increasing means are able to effectively increase the shearing force exerted on the viscous fluid.

Because the grooves 31, 32 are employed as recesses in the heat generating effective area, gas (air, etc.) mixed in the viscous fluid can be captured in the grooves 31, 32. This enables the gas to be purged from the gap between the outer circumferential surface of the rotor 20 and the inner circumferential surface of the stator member 2 (specifically, the gaps defined by portions other than the grooves 31, 32). It is hence possible to maintain and increase the heat generating ability as a result of such a gas capturing action.

The tops of both side walls defining each of the grooves 31, 32 in the outer circumferential surface of the rotor 20 and the inner circumferential surface of the stator member 2, respectively, are formed as angled edges. Therefore, compared with the case where the tops are chamfered to have round edges, the action of confining molecule chains of the viscous fluid is promoted and shearing of the viscous fluid is achieved more effectively. Further, since the gas captured in the grooves 31, 32 is less likely to escape from them, the function of the grooves 31, 32 to store gas therein is enhanced, which contributes to increasing the shearing force exerted on the viscous fluid.

Because the number of the grooves 31 on the rotor 20 is different from the number of the grooves 32 on the stator member 2, the angular intervals between the grooves 31 arranged on the rotor 20 differs from the angular intervals between the grooves 32 arranged on the stator member 2. During the rotation of the rotor 20, therefore, it is possible to avoid the twenty-four grooves 31 formed on the rotor 20 and the thirty-six grooves 32 formed on the stator member 2 from all being positioned to face each other at the same time. Consequently, torque fluctuations (load fluctuations) occurring during the rotation of the rotor 20 are so very small that the occurrence of vibrations and noise attributable to the torque fluctuations can be controlled effectively.

By forming the grooves 32 on the stator member 2 in larger number, the surface area of the wall interposed between the heat generating chamber 7 and the water jacket (the heat radiating chamber) 8 for heat exchange can be increased. Therefore, the heat generated in the heat generating chamber 7 can be efficiently transmitted to the circulating fluid flowing in the heat radiating chamber 8. This is also effective in keeping the heat from being accumulated in the heat generating chamber 7, and hence controlling a reduction in the heat generating action of the viscous fluid.

Incidentally, the first embodiment may be modified as follows.

While the grooves 31, 32 are formed respectively on the outer circumferential surface of the rotor 20 and the inner circumferential surface of the stator member 2, this arrangement may be modified such that only the grooves 31 are formed on the outer circumferential surface of the rotor 20 and no grooves are formed on the inner circumferential surface of the stator member 2. On the contrary, the above arrangement may be modified such that no grooves are formed on the outer circumferential surface of the rotor 20 and only the grooves 32 are formed on the inner circumferential surface of the stator member 2. In either case, operation and advantages similar to those in the above first embodiment can be achieved.

Figure 4:
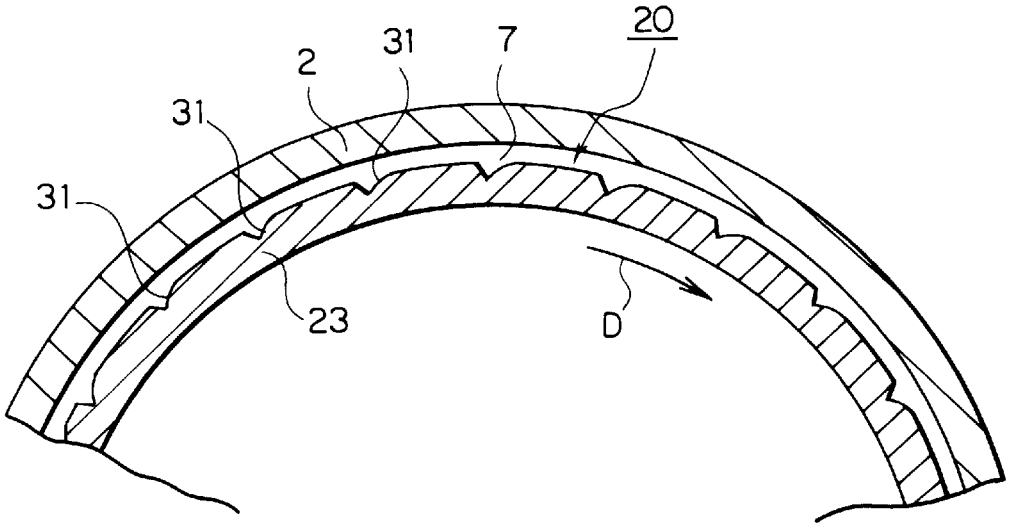
FIG. 4 is a partial transverse sectional view showing another example of the rotor.

Further, as shown in FIG. 4, the grooves 31 formed on the outer circumferential surface of the rotor 20 may each have a wedge-shaped cross section. In this case, each groove 31 is formed to have a wedge shaped cross section such that the wedge has a moderate slope on the front side in the direction D of rotation of the rotor 20 and a steep slope on the rear or following side. With this construction, the top of the sloped wall defining the groove on the rear side in the direction D of rotation of the rotor 20 has an angled edge which serves to increase the shearing force exerted on the viscous fluid upon the rotation of the rotor 20 and enhance the function of the grooves 31 to store gas therein. Additionally, similar to the above wedge-shaped grooves 31, the grooves 32 may be formed to have a wedge-shaped cross section in the inner circumferential surface of the stator member 2 as partitioning means.

(Second Embodiment)

Figure 5:
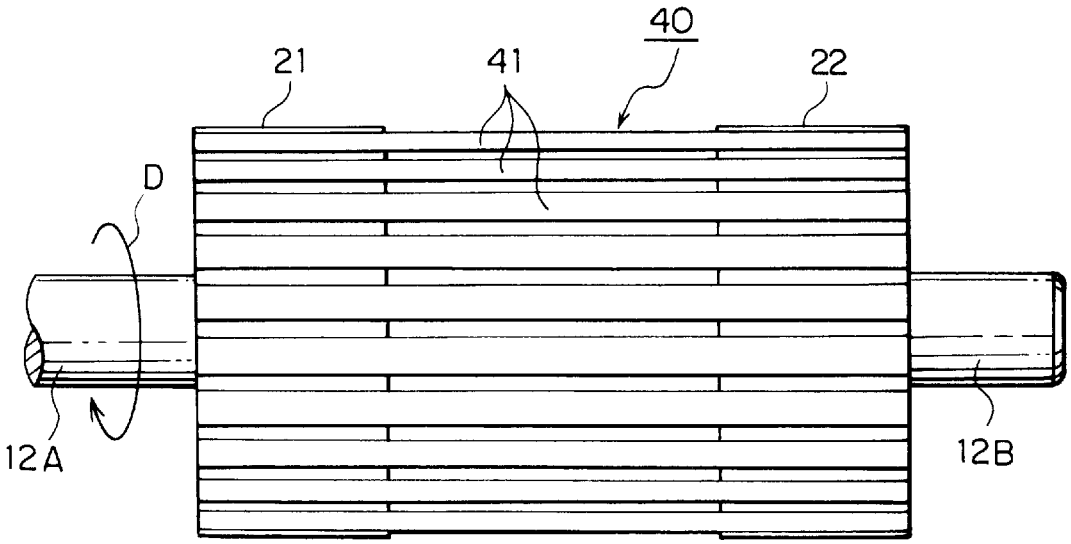
FIG. 5 is a front view of a rotor of a viscous heater according to a second embodiment.

A second embodiment will be described below. In the viscous heater shown in FIGS. 1 to 3, the drum-like rotor 20 may be replaced with a cage type rotor 40 as shown in FIG. 5. The cage type rotor 40 is constructed by replacing the outer periphery member 23 of the drum-like rotor 20 with a plurality of connecting members 41. More specifically, the plurality of connecting members 41 are fixed to outer peripheries of the pair of disk-shaped support members 21, 22 which are spline-jointed respectively to the front and rear drive shafts 12A, 12B and are spaced a predetermined distance in the longitudinal direction. The connecting members 41 are each formed of a long plate- or rod-like member whose length corresponds to the axial length L of the rotor 40. The connecting members 41 are arranged side by side in the circumferential direction of the rotor 40 with equal angular intervals therebetween and are extended in the axial direction of the rotor 40 (the axial direction of the drive shafts 12A, 12B) parallel to each other. Between adjacent connecting members 41, gaps through which the inner space of the cage type rotor 40 is communicated with the heat generating chamber 7 are defined.

By using the cage type rotor 40, the inner space of the rotor 40 can be utilized as a chamber for storing silicone oil (viscous fluid). This is advantageous in that it enables the silicone oil to be stored in a larger amount so that it to starts to deteriorate only after a longer period of time. The use of the cage type rotor 40 also makes it possible to reduce the start-up torque of the rotor and reduce the start-up shock. Further, when the rotor 40 starts rotating, in addition to the action of centrifugal force, the silicone oil is forced to uniformly spread over the entire outer periphery of the rotor 40 under the action of the connecting members 41 which entrain or comb the oil upward. As a result, the oil is effectively subjected to shearing by the connecting members 41.

With the rotation of the cage type rotor 40, the connecting members 41 move along the inner circumferential surface of the stator member 2 as partitioning means while keeping on opposed relation thereto, but vary the gap size between the outer periphery of the rotor 40 and the inner circumferential surface of the stator member 2 along the direction D of the rotation of the rotor 40. In the second embodiment, therefore, the plurality of connecting members 41 serve as the shearing force increasing means.

(Third Embodiment)

Figure 6:
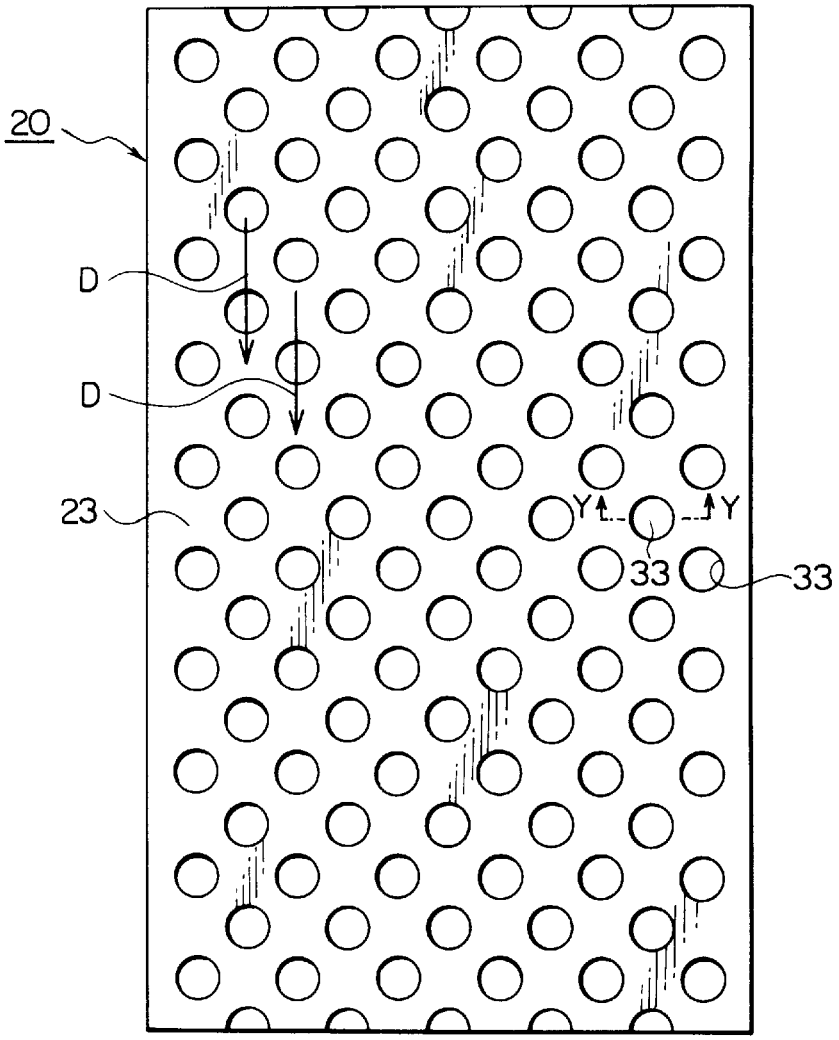
FIG. 6 is a developed view of a rotor of a viscous heater according to a third embodiment.

A third embodiment will be described below. The shearing force increasing means to be provided on the drum-like rotor 20 is not limited to the grooves 31 (or ribs) extending in the axial direction of the rotor. As shown in FIG. 6, a plurality of dimples 33 may be formed on the outer circumferential surface of the outer periphery member 23 defining the outer circumferential surface of the rotor 20. FIG. 6 schematically shows the outer periphery member 23 of the drum-like rotor 20 in a form resulting from cutting the outer periphery member 23 along a line extending in the axial direction and making it flat. In a plan view, the dimples 33 are circular. The dimples 33 are distributed over the entire outer circumferential surface of the outer periphery member 23 with such a regularity that they are arrayed to lie on lines extending in the direction D of the rotation of the rotor 20, and are spaced from each other in each of the lines by predetermined intervals (consequently, equal angular intervals) therebetween.

Figure 7A:
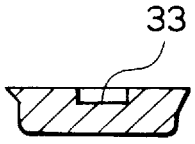
FIGS. 7A and 7B are each a sectional view taken along the line Y—Y in FIG. 6, showing the form of a dimple in an outer circumferential surface of the rotor.
Figure 7B:
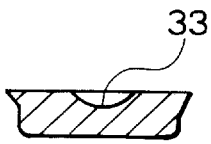

FIG. 7 shows a cross section of each of the dimples 33. The cross-sectional shape of each dimple 33 may be rectangular (see FIG. 7A) or saucer-like (see FIG. 7B) However, when the dimple 33 have a rectangular cross section, the top of a peripheral wall defining the dimple 33 has an angled edge, thus enabling the dimple 33 to exert a greater shearing force on the viscous fluid and enhance the function of storing gas as stated above. Any suitable method can be used to form the dimples 33. For example, the dimples 33 may be formed by electro-discharge machining by setting columnar electrodes in opposed relation to the outer circumferential surface of the outer periphery member 23 after forming the cylindrical outer periphery member 23. Alternatively, the dimples 33 may be formed at the same time the cylindrical outer periphery member 23 is forged.

With the presence of the dimples 33 formed as stated above, the gap size between the outer circumferential surface of the rotor 20 and the inner circumferential surface of the stator member 2 varies in the direction D of rotation of the rotor 40. In the third embodiment, therefore, the dimples 33 serve as the shearing force increasing means. Additionally, dimples similar to the dimples 33 may be formed on the inner circumferential surface of the stator member 2. Also, the shape of the dimples 33 in plan view is not limited to a circle, but may be elliptic or polygonal for example, square.

It should be understood that the present invention is not limited to the above first to third embodiments, but may be modified as follows.

(1) In the above first to third embodiments, the spiral rib 2*a* is projected on the outer circumferential surface of the stator member 2. Instead of the rib 2*a*, however, a number of heat radiating fins may be formed over almost the entire outer circumferential surface of the stator member 2 such that distal ends of the fins do not contact the inner circumferential surface of the intermediate housing 1.

(2) In the above first to third embodiments, the pulley 18 is directly fixed to the end of the drive shaft 12A as described in connection with the viscous heater of FIG. 1. However, an electromagnetic clutch mechanism may be disposed between the pulley 18 and the drive shaft 12A so that the driving force of the engine can be selectively transmitted to the drive shaft 12A etc. as required.

(3) Radial grooves may be formed on the front and rear end surfaces of the drum-like rotor 20 or the cage type rotor 40, whereas similar radial grooves may be formed on the inner wall surfaces facing the front and rear end surfaces of the rotor. These radial grooves function as a shearing force increasing means provided at both end surfaces of the substantially columnar rotor to increase the shearing force exerted on the viscous fluid.

The term "viscous fluid" employed in the foregoing description of this specification implies all kinds of media which are able to generate heat by fluid friction when subject to the shearing action upon the rotation of a rotor. Accordingly, the viscous fluid is neither limited to a liquid or a semiliquid having high viscosity, nor to silicone oil.

What is claimed is:

1. A viscous heater comprising a housing, a heat generating chamber, a rotor within said heating chamber for rotation therein, and a heat exchange chamber, said heat generating chamber for containing a viscous fluid subject to shearing upon rotation of said rotor to generate heat, the generated heat being transmitted to a circulating fluid in said heat radiating chamber, thereby heating said circulating fluid, a partitioning means provided in said housing to surround an outer periphery of said rotor to define said heat generating chamber on the inner peripheral side of said partitioning means and said heat exchange chamber on the outer peripheral side of said partitioning means, and a plurality of shearing force increasing means provided on at least one of said rotor and said partitioning means to increase a shearing force exerted on said viscous fluid, said plurality of shearing force increasing means being positioned discontinuously in the direction of rotation of said rotor, thereby varying the gap size between said rotor and said partitioning means in the direction of rotation of said rotor.

2. The viscous heater according to claim 1, wherein said plurality of shearing force increasing means comprises recesses and projections formed to extend in a direction other than the direction of rotation of said rotor on at least one of the outer circumferential surface of said rotor and the inner circumferential surface of said partitioning means positioned to face the outer circumferential surface of said rotor.

3. The viscous heater according to claim 2, wherein said recesses and projections comprise a plurality of grooves extending in the axial direction of said rotor on at least one of the outer circumferential surface of said rotor and the inner circumferential surface of said partitioning means.

4. The viscous heater according to claim 3, wherein said recesses and projections comprise a plurality of grooves extending in the axial direction of said rotor on both the outer circumferential surface of said rotor and the inner circumferential surface of said partitioning means, the number of said grooves on said rotor being different from the number of said grooves on said partitioning means.

5. The viscous heater according to claim 4, wherein said grooves are defined by opposing side walls, each side wall having a top with an angled edge.

6. The viscous heater according to claim 5, wherein a percentage of the total area of said outer circumferential surface of said rotor occupied by said grooves on said rotor and a percentage of the total area of said inner circumferential surface of said partitioning means occupied by said grooves on said partitioning means are each not larger than 20%.

7. The viscous heater according to claim 1, wherein said rotor comprises a pair of disk-like support members spaced from each other by a predetermined distance in the longitudinal direction, and a plurality of connecting members fixedly attached to outer peripheries of said disk-like support members, said connecting members being moved along the inner circumferential surface of said partitioning means upon rotation of said rotor while keeping an opposed relation to the inner circumferential surface of said partitioning means, whereby said plurality of connecting members serve as said plurality of shearing force increasing means.

8. The viscous heater according to claim 1, wherein said plurality of shearing force increasing means comprises a plurality of dimples formed in a distributed manner in at least one of the outer circumferential surface of said rotor and the inner circumferential surface of said partitioning means positioned to face the outer circumferential surface of said rotor.

9. The viscous heater according to claim 1, wherein said rotor has a cylindrical shape and said outer circumferential surface of said rotor has an axial length greater than its radius.

10. The viscous heater according to claim 9, wherein said heat exchange chamber defines a spiral circulating passage for circulating fluid therethrough.

* * * * *